United States Patent [19]

Neill, Jr.

[11] 4,245,720

[45] Jan. 20, 1981

[54] FAST FOOD RESTAURANT

[76] Inventor: Scott E. Neill, Jr., 4275 E. Itliff #303, Denver, Colo. 80222

[21] Appl. No.: 12,833

[22] Filed: Feb. 16, 1979

[51] Int. Cl.[3] ..... E04H 3/04

[52] U.S. Cl. ..... 186/38

[58] Field of Search ..... 99/485; 312/140.1, 198; 186/38, 44, 49, 42

[56] References Cited

U.S. PATENT DOCUMENTS 4,074,793 2/1978 Yuter ..... 186/1 R

*Primary Examiner*—Stanley H. Tollberg

*Attorney, Agent, or Firm*—Cahill, Sutton & Thomas

[57] ABSTRACT

The food preparation area of a fast food restaurant is configured in the manner of a continuous production line and includes two grills disposed within reach of and on either side of the chef. Make up tables extend from common ends of the grills and supply the food elements to be combined by an operator with individual meats grilled on the respective grills. The make up tables are abut a counter extending perpendicular thereto and from which counter ancillary food products and beverages normally attendant an order for the grilled meats are dispensed. A serving counter parallel to but laterally displaced from the counter supports the cash registers and order boards recording each order and viewable by the chef and make up table operators.

10 Claims, 1 Drawing Figure

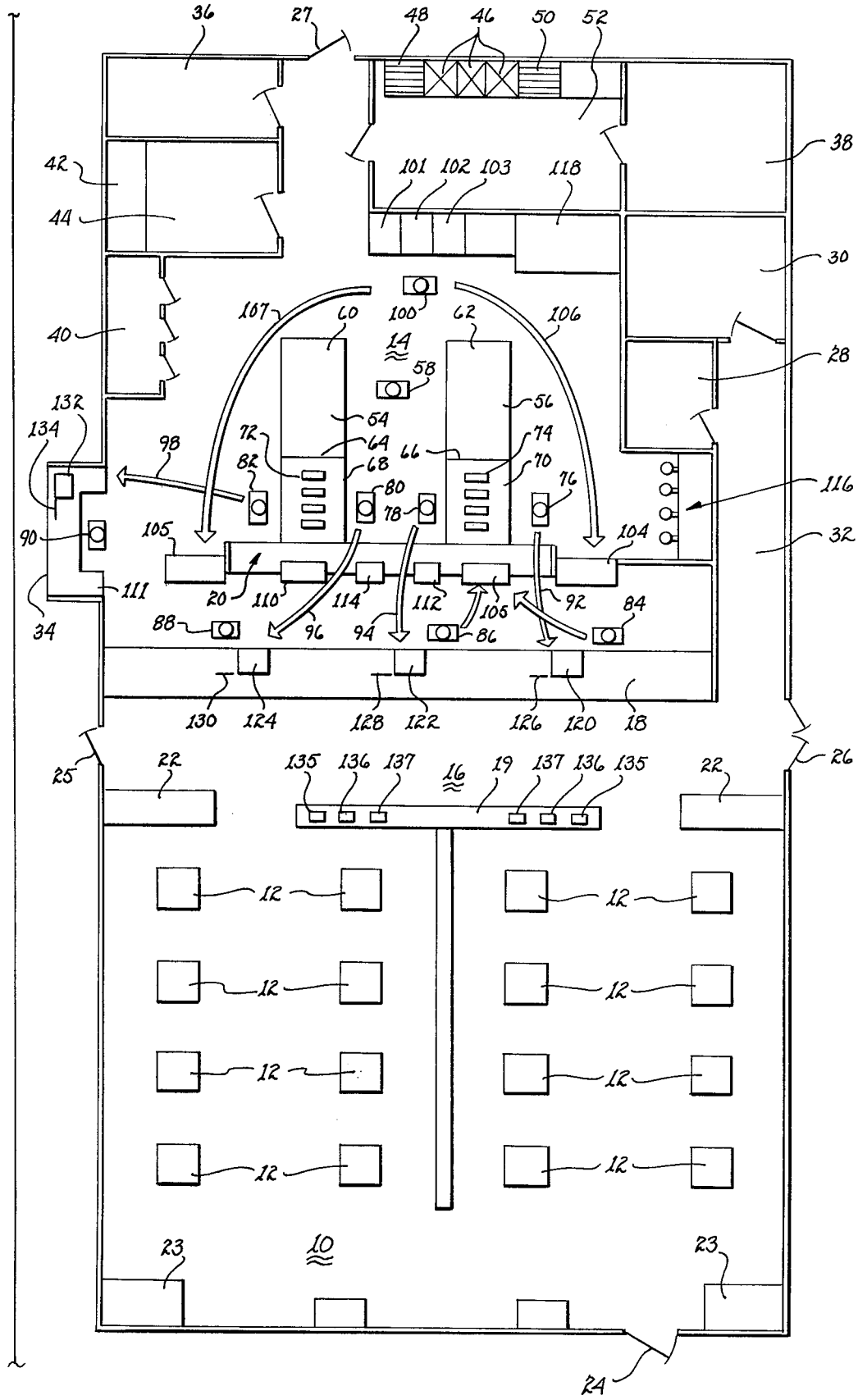
36
27
48
46
50
52
38
42
44
101
102
103
118
30
40
107
60
100
62
106
14
58
28
132
134
54
56
72
64
66
74
98
82
68
70
116
80
76
78
90
105
104
32
111
20
110
114
112
108
92
84
34
88
96
94
86
130
124
128
122
126
120
18
25
22
135
136
137
16
19
137
136
135
22
26
12
12
12
12
12
12
12
12
23
10
23
24

FAST FOOD RESTAURANT

The present invention relates to food preparation and, more particularly, to a production line arrangement of the food preparation and assembly area in a fast food restaurant.

Fast food restaurants specializing in preparing and serving hamburgers abound. The forte of these restaurants is predicated upon the ability to provide palatable hamburgers within a minimum time period from the moment an order is placed by a customer. To accomplish this goal, some fast food restaurants pre-grill the meats and maintain them hot under radiant heat sources; other fast food restaurants begin grilling the hamburger meat on placement of an order with the hope of having the meat grilled by the time the total order of ancillary foods, such as french fries, drinks etc. are assembled and delivered to the customer.

Either method has certain disadvantages and advantages. Where the hamburgers are cooked before an order is placed, the meat often tends to dry out and looses a great deal of its flavor; the loss of flavor is often compensated by the use of various sauces and the like. The hamburgers grilled upon placement of an order therefor are relatively juicy and palatable but the number of orders which can be handled per time period is necessarily limited by the physical size of the grills.

From an economic standpoint, fast food restaurants are or are not commercial successes depending upon the number of orders which are handled during the lunch period. As the lunch period extends for only two hours or less, depending upon whether the customers are primarily white collar workers or blue collar workers, speed of execution of completed orders is paramount. Thus, fast food restaurants which precook their hamburgers can readily accommodate a substantial flow of orders but suffer due to the poor taste of the hamburgers. Those fast food restaurants which grill the hamburgers after an order is placed are limited by the mechanical arrangement of the grills, make up tables and personnel whereby a loss of business occurs during rush periods.

It is therefore a primary object of the present invention to provide a production line facility in the food preparation area of a fast food restaurant which can accommodate any production rate.

Another object of the present invention is to provide an efficient arrangement of grills, make up tables and ancillary food counters for fast food restaurants.

Yet another object of the present invention is to provide a structural arrangement in the food preparation area of a fast food restaurant which promotes operator efficiency.

Still another object of the present invention is to provide a structural arrangement in a fast food restaurant which incorporates mass production techniques.

A further object of the present invention is to provide a food preparation area in a fast food restaurant which is capable of filling a food order between the time the order is placed and payment therefor is made by the customer.

A still further object of the present invention is to provide an arrangement of equipments for a fast food restaurant which is capable of a high production rate without degradation of palatability of the goods being prepared.

A still further object of the present invention is to provide an arrangement of food preparation equipment in a fast food restaurant, which equipment is useable in the rapid preparation of a variety of foods.

These and other objects of the present invention will become apparent to those skilled in the art as the description thereof proceeds.

The present invention may be described with greater specificity and clarity with reference to the sole FIGURE illustrating a plan view of a fast food restaurant incorporating the principles of the present invention.

Fast food restaurants serve three general types of customers: those who wish to eat their ordered food within the restaurant; those who wish food to takeout; and, those who wish to place their food orders from their cars for consumption at a remote location. Accordingly, any fast food restaurant must be capable of accommodating these three types of customers or else forfeit a portion of their potential business.

THE DRAWING SHOWS A PLAN VIEW OF A RESTAURANT.

Referring to the sole FIGURE, there is shown a plan view of a fast food restaurant which is capable of accommodating all three major types of customers. The front half of the restaurant includes a dining area 10 having a plurality of table and chair assemblies 12 for use by the customers. The configuration of these table and chair assemblies may be that of any one of many well known commercially available assemblies. Approximately half of the fast food restaurant floor area is taken up by the food preparation area 14. The food preparation area is divided from the dining area by a passageway 16 transverse to the restaurant and generally bounded by serving counter 18, shelf 19 and trash bins 22. Ingress and egress from both dining area 10 and passageway 16 is provided by doors 24 and 26; an emergency side door 25 and rear door 27 may be incorporated. Additional trash bins 23 may be disposed at the far end of dining area 10. Restrooms 28 and 30 located toward the rear of the restaurant are accessible to the customers through hallway 32. A service window 34 provides communication with customers arriving in their cars. Placement of orders by these customers may occur at a remote location by means of a speaker system whereby on arriving at service window 34 the order has been assembled and delivery may be made to the customer upon payment therefore.

Food preparation area 14 includes various storage and service facilities. A coatroom 36 for the benefit of the employed personnel is provided. A freezer 38 houses and preserves the food products in a frozen state until needed. Similarly, a cooler 40 houses those food elements which are not to be frozen but must be stored in a chilled environment until needed. Non-perishable throwaway items, such as napkins, plates, cups, etc. are located upon shelves 42 or in boxes within storage room 44. Sinks 46 and attendant work tables 48 and 50 are included within a room 52 to provide for cleaning of the various equipments employed in operating the fast food restaurant.

The heat of any fast food restaurant is predicated upon the types and arrangement of equipments used in the actual preparation of the foods and assembly of complete orders.

Years ago, Henry Ford taught the world the principles of mass production, yet many industries have failed to heed his teachings. One of these industries is the restaurants. In the following description, a production line for preparing foods will be described.

To provide sufficient grilling capacity to prepare an unlimited number of grilled meats, such as hamburgers, two elongated grills 54 and 56 are employed. These grills parallel one another and are spaced apart from one another by a distance just sufficient to permit a chef (depicted by numeral 58) to stand therebetween and be able to reach the full surface of both grills by simply turning from one grill to the other and without taking any steps. In operation, the chef places the fresh meat patties in proximity to ends 60 and 62 of grills 54 and 56. As the patties are being grilled, they are repositioned toward ends 64 and 66 ar a rate such that the patties would be well done on arrival in proximity to ends 64 and 66. For those customers desiring cheese burgers, the operator would add the cheese to the respective hamburger patties while they are being grilled upon grills 54 and 56.

Make up tables 68 and 70 extend from ends 64 and 66 of grills 54 and 56, respectively. These make up tables include a work area for an operator to assemble the hamburgers in accordance with each customer's specification. That is, an operator at a make up table would remove the patties from the grill when rare, medium or well done. And, the operator would have access to the hamburger buns and toast them as required. To meet the requirements of individualized orders, a plurality of bins 72 and 74 are conjoined with the respective make up tables. These bins include the conventional items added to hamburgers, such as lettuce, tomatoes, pickles, mayonaise, mustard, etc. As some customers may wish the hamburger buns not to be toasted, a supply of untoasted buns are also included at the make up tables.

One of operators 76, 78, 80 and 82 stands at each side of each make up table and services the orders taken by one of the cashiers. That is, operator 76 assembles those orders taken by cashier 84; operator 78 assembles those orders taken by cashier 86; operator 80 assembles those orders taken by cashier 88; and operator 82 assembles those orders taken by cashier 90.

The make up tables abut, perpendicularly, counter 20, which counter is used to transfer foods from the operators at the make up tables to the cashiers. The respective flow of foods from the operators to the cashiers of the assembled hamburgers is indicated by arrows 92, 94, 96 and 98.

A very common fare usually accompanying an order for hamburgers is that of french fries. The french fries are prepared by operator 100. This operator fries the french fries in deep fryers 101, 102 and 103. The prepared french fries are delivered by operator 100 to french fry storage bins 104 and 105 in counter 20. This delivery of french fries is depicted by arrows 106 and 107. Thereby, the available supply of french fries from bins 104 and 105 can be regulated by operator 100 to be commensurate with any changes in the rate of orders for french fries.

Soft drinks and other beverages, such as milk, are dispensed from dispensers 108 and 110 associated with counter 20. Dispenser 108 is located between and serves cashiers 84 and 86; dispenser 110 is located between and serves cashiers 88 and 90. Thereby, the cashiers, intermediate the taking of an order and payment therefor, will fill that portion of the order which pertains to liquid refreshment. Malts and milkshakes are generally requested by a proportion of the customers. These are made up at malt machine 112 during slack periods and stored in malt holder 114. One of the cashiers, when traffic flow allows, will make up a quantity of malts and milkshakes commensurate with experience and place them in the malt holder for access to all the cashiers.

Soft drink dispensers 108, 110 and 111 are connected to a conventional dispensing unit 116, which unit automatically mixes the respective syrups with carbonated water to dispense, via tubing or hoses, through petcocks in each of the dispensers the appropriate soft drink. Dispensation of crushed ice from ice machine 118 may occur automatically upon actuation of one of dispensers 108, 110 and 111; in the alternative, ice bins may be attached to the dispensers for use by the cashiers and maintained filled by operator 100.

Serving counter 18 includes registers 120, 122 and 124. These registers serve the conventional function of receiving money and ringing up the sales when made and serve a secondary function of supporting orders boards depicted by numerals 126, 128 and 130. These order boards are visible to the operators at the make up tables so that they can monitor the production rate necessary to maintain a continuing flow of food and custom prepare each order.

On receipt of an order, a cashier will note the order upon the respective order board and may or may not verbalize the order for the benefit of chef 58 and operators 76, 78, 80 and 82. Thus, on receipt of an order, the appropriate operator at one of the make up tables can immediately begin to make up the hamburger(s) from an end 64 and 66 of the grills as specifically requested by the customer by viewing the order board and/or listening to the verbalized order. Simultaneously, chef 58 can add a sufficient number of hamburger patties to the respective grill to replace the removed patties and thereby maintain a continuous flow of hamburger patties under preparation.

Cashier 90, at service window 34, also has a register 132 and an attendant order board 134. Operator 82, at make up table 68, looks at order board 134 or listens to the orders received and immediately begins to make up the hamburgers specified by the customer.

The ancillary items usually accompanying or attendant orders placed in fast food restaurants are located upon shelf 19 and are accessible to each of the customers. These items include such things as napkins disposed in bins 135, straws disposed in bins 136 and forks and other cutlery disposed in bins 137.

As pointed out above, the single function in fast food restaurants which places a limitation upon the rate of delivery of orders is that of the time required to serve freshly cooked foods and thereby assure serving of the food when it is most flavorful. The structural relationships described above provide a production line environment for a continuing flow of freshly grilled hamburger patties to the customer at the moment at which an order is placed. The flow rate can be readily and easily controlled by the chef commensurate with demand; thus, the demand during peak hours of operation, lunch time, can be readily satisfied.

It is to be understood that other foods such as fish, hotdogs, etc. can also be prepared within the facility described above.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A kitchen facility for sequentially assembling in a production line manner a food order in a fast food restaurant, said facility comprising in combination:

(a) a pair of grills for cooking foods, said grills being spaced apart from one another at a distance sufficient to accommodate a chef therebetween to cook simultaneously on both grills;

(b) a first make up table extending from one of said grills for supplying food items to be combined with the foods cooked on the adjacent one of said grills;

(c) a second make up table extending from another of said grills for supplying food items to be combined with the foods cooked on the adjacent one of said grills;

(d) a counter interconnecting each of said first and second make up tables for dispensing any ancillary food items ordered with an order for the cooked foods; and (e) a serving counter extending parallel to but laterally spaced from said counter for serving the foods ordered to customers;

whereby, said facility promotes production line assembly of the foods ordered.

2. The kitchen facility as set forth in claim 1 including a take out window adjacent one of said make up tables, a serving counter proximate said window, an order board for recording an order and a cash register.

3. The kitchen facility as set forth in claim 1 wherein said serving counter includes a plurality of cash registers and an order board attendant each of said cash registers, each of said order boards being viewable by the chef located between said grills and by an operator at one of said make up tables.

4. The kitchen facility as set forth in claim 3 including a take out window adjacent one of said make up tables, a serving counter proximate said window, an order board for recording an order and a cash register.

5. The kitchen facility as set forth in claim 4 wherein said facility includes means for positioning an operator adjacent each of said make up tables and proximate each of said cash registers.

6. The kitchen facility as set forth in claim 5 including beverage dispensers disposed in said counter.

7. The kitchen facility as set forth in claim 6 further including a cooking unit remote from said counter for preparing foods dispensed from said counter.

8. The kitchen facility as set forth in claim 7 wherein said remote facility includes deep fryers.

9. The kitchen facility as set forth in claim 8 including a further remote facility for mixing the beverages dispensed from said beverage dispensers and conveying the beverages from said further remote facility to said beverage dispensers.

10. The kitchen facility as set forth in claim 9 wherein said facility includes means for storing the foods preparatory to cooking of the foods.

* * * * *